US006786240B2

(12) United States Patent
Ouyoung

(10) Patent No.: US 6,786,240 B2
(45) Date of Patent: Sep. 7, 2004

(54) SPOUT ASSEMBLY

(75) Inventor: Scott Ouyoung, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 19 days.

(21) Appl. No.: 10/293,263

(22) Filed: Nov. 14, 2002

(65) Prior Publication Data

US 2004/0094219 A1 May 20, 2004

(51) Int. Cl.[7] ..... E03C 1/02
(52) U.S. Cl. ..... 137/801; 4/677
(58) Field of Search ..... 4/677; 137/801

(56) References Cited

U.S. PATENT DOCUMENTS 6,623,045 B2 * 9/2003 Wurgler ..... 285/201
6,712,094 B1 * 3/2004 Chen ..... 137/801

* cited by examiner

*Primary Examiner*—Gerald A. Michalsky
(74) *Attorney, Agent, or Firm*—Leong C. Lei

(57) ABSTRACT

An improved structure of sprout assembly to allow it to be externally fixed to the faucet without welding and permit faucet and sprout to be plated first before connecting both to each other is characterized by that a connector in the faucet to engage a locking sleeve in the sprout, and a threaded tube being inserted through both of the connector and the locking sleeve.

2 Claims, 5 Drawing Sheets

PRIOR ART

SPOUT ASSEMBLY

BACKGROUND OF THE INVENTION (a) Field of the Invention

The present invention is related to a spout assembly, and more particularly, to one that can be externally locked to the faucet for fast assembly.

(b) Description of the Prior Art

As people now demand more on the product quality, the manufacturers also demand more on the process quality since good process quality is the only way to effective upgrade the appearance of the product. Manufacturers of products such as the dial of a wristwatch, the appearance of an automobile and assembly of sanitary ware have been improving the assembly appearance to directly promote product image and indirectly stimulate the market demands and higher selling price. FIG. 1 of the accompanying drawing of the present invention shows a structure of the prior art of a spout assembly 20 adapted to a faucet 10. As illustrated in FIGS. 2 and 2A for an assembly of the spout assembly 20 and the faucet 10 in the prior art, the spout assembly 20 is usually directly welded to a water outlet 13 on the faucet 10 to fix the spout assembly 20 to the outer circumference of the faucet 10. However, the prior art is found with the following defectives:

1. The surface of the welded joint prevents easy access for finishing. As a protruded welded joint 22 is located at a corner where prevents easy access and the spout assembly 20 relates to a round tube making the use of mechanical tools very difficult to access for surface finish; and even the finishing is provided, the surface remains comparatively rough.
2. Surface is stripped after plating process. Since the faucet must go through the conventional welding process before entering into the next process of plating for finishing. However, during the plating process, the rough surface of the welded joint 22 will fail a consistent surface attachment of the plated surface. Consequently, the plated surface on the welded joint 22 will start to strip off to increase the percentage of defectives of a production lot.

SUMMARY OF THE INVENTION

The primary purpose of the present invention is to provide an improved structure of the spout assembly 20 that can be fixed to the faucet without welding, thus to improve the appearance of the finish product.

Another purpose of the present invention is to provide an improved structure of the spout assembly 20 that permits to have both of the spout assembly 20 and the faucet 10 to be separately plated before fixing the spout assembly 20 to the faucet 10 for rapid assembly of the faucet at a reduced production cost.

To achieve the purposes, a connector is provided in the faucet 10 to be inserted into a locking sleeve provided in the spout assembly 20.

DETAILED DESCRIPTION OF THE PREFERRED EMBODIMENTS

Figure 1:
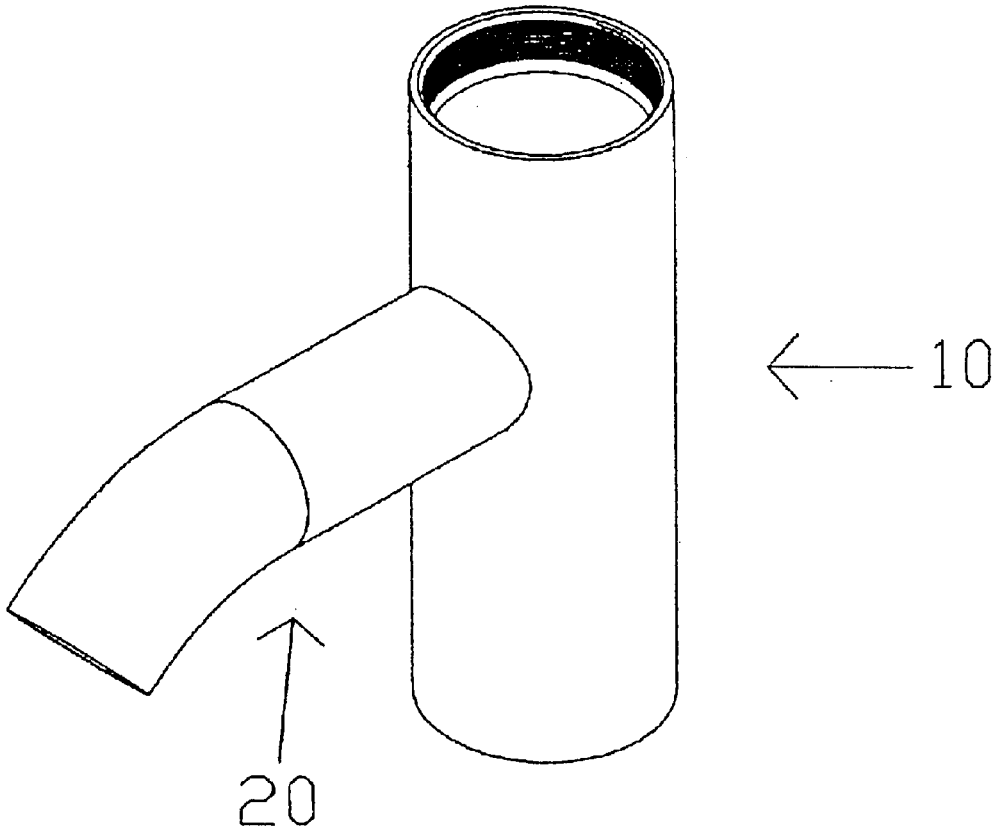
PRIOR ART FIG. 1
FIG. 1 is a schematic view of a spout of the prior art
Figures 2, 2A:
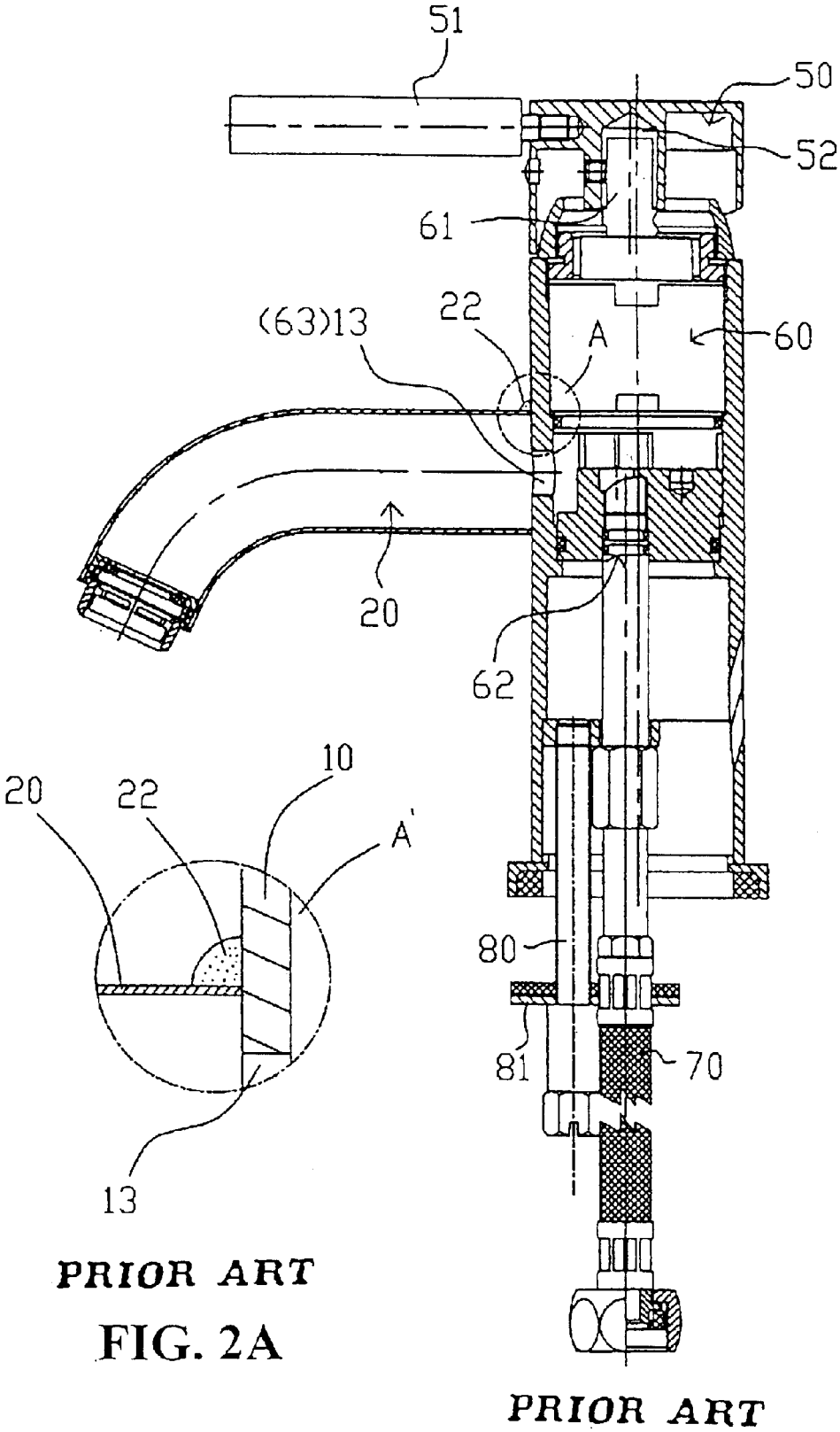
FIG. 2A PRIOR ART
FIG. 2 is a sectional view of the spout assembly of the prior art.
FIG. 2A is an enlarged view of a portion of FIG. 2.
Figure 3:
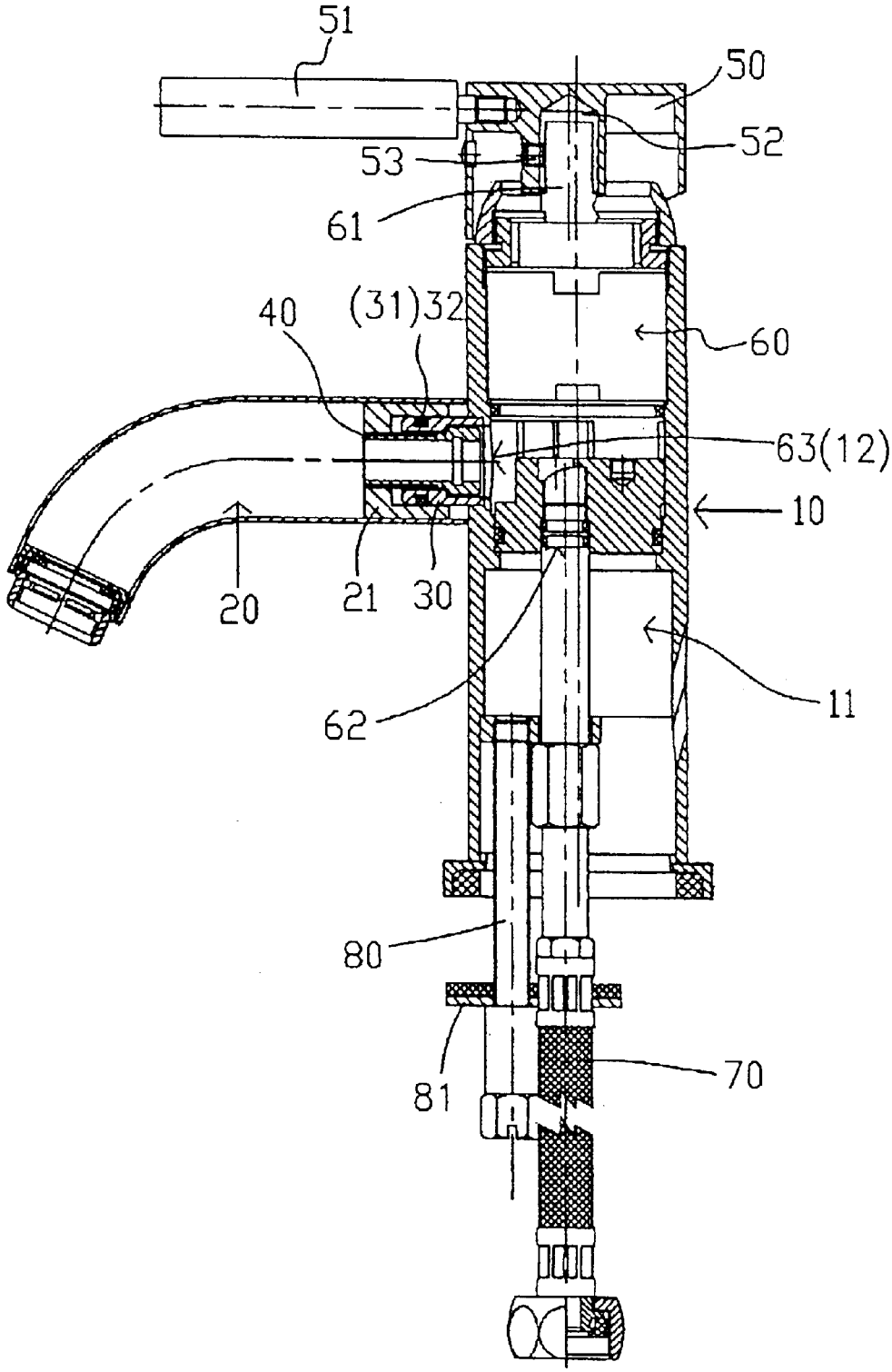
FIG. 3 is a sectional view of a preferred embodiment of the present invention.
Figure 4:
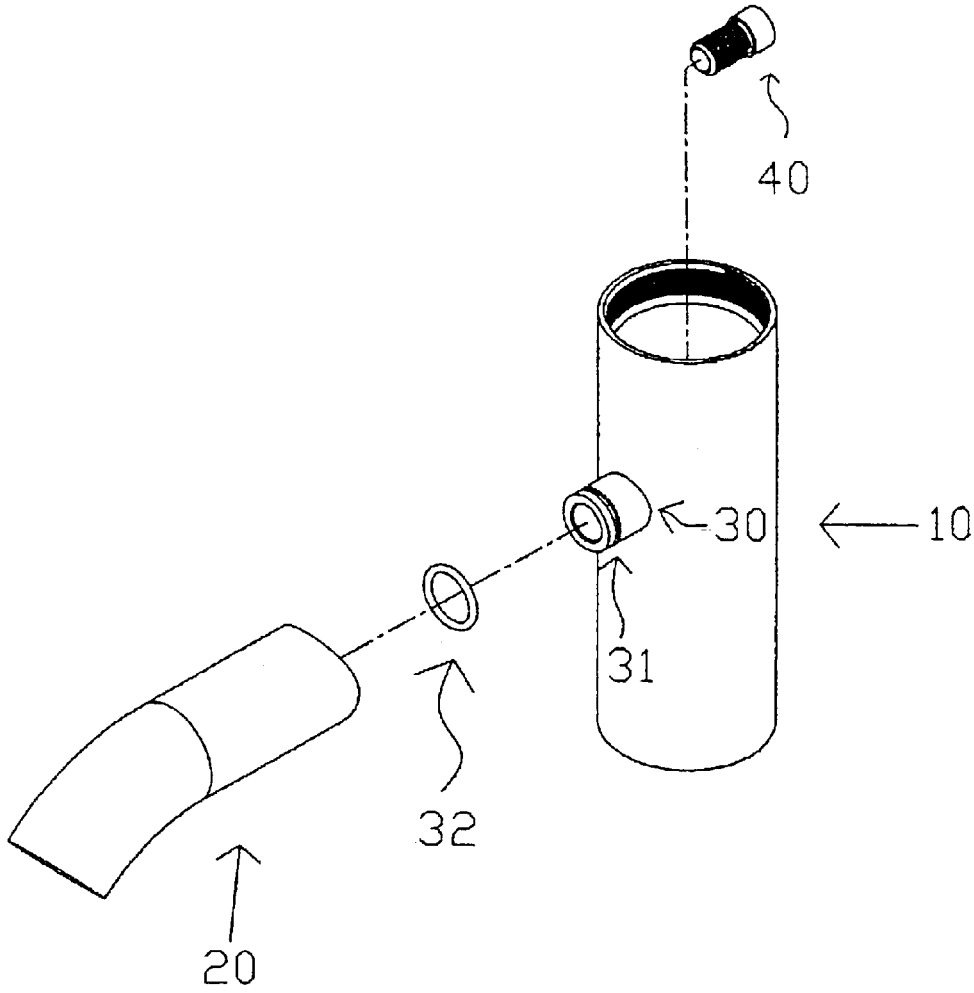
FIG. 4 is an exploded view of the preferred embodiment of the present invention.
Figure 5:
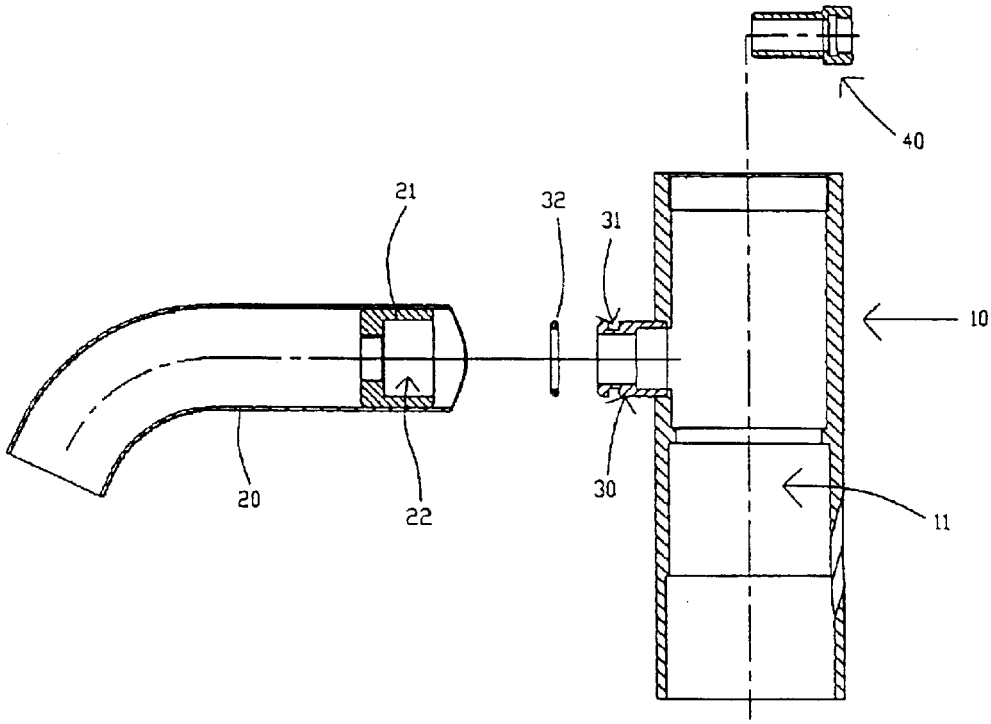
FIG. 5 is a sectional view showing partially an assembly of the preferred embodiment of the present invention.

Referring to FIGS. 3, 4 and 5, the internal structure design of a preferred embodiment of the present invention is generally similar to that of a prior art. Wherein, a temperature control valve 60 in shape compromising a bore 11 inside a faucet 10 is fixed in approximately at the middle section of the bore 11. A water outlet 12 connected through the interior of the temperature control valve 60 is provided at the outer circumference of the faucet in front of the temperature control valve 60. A cartridge stem 61 extends upward from the upper end of the temperature control valve 60 to control the mixing ratio of hot water and cold water inside the temperature control valve 60. Multiple water inlets 62 are provided at the lower end of the temperature control valve 60 to introduce hot water and cold water into the temperature control valve 62 for mixing at a controlled temperature. On the outer circumference at the front of the temperature control valve 60 a water outlet 63 is provided to deliver the mixed hot and cold water through the water outlet 12. An inwardly recessed cover 50 in the same outer diameter as that of the faucet is fixed to the upper part of the cartridge stem 61 so to cover up the top of the faucet 10. A chamber 52 is provided inside the cover 50 so that a screw 53 is used to externally secure the cover 50 and the cartridge stem 61. A threaded handle 51 is externally screwed into the front of the cover 50. Those water inlets 62 are connected to multiple water pipes 70 to introduce both hot water and cold water. A cartridge 80 is screwed to the lower part of the faucet 10. A packing 81 is provided at where below the cartridge 80 to support the faucet 10 on a sink.

The improved structure of the spout assembly is essentially made by having fixed a hollow, cylindrical connector 30 into the water outlet 12. Female threads are provided on the inner circumference of the connector 30 to engage a threaded tube 40 and protruding forward with its outer circumference fixed at its rear to the water outlet 12 and a groove being provided on its front circumference to receiver insertion of an O-ring 32. The tube 40 related to a threaded tube provided with male threads on its outer circumference to be inserted through the connector 30. The rear end of the threaded tube 40 is formed with a nut in diameter slightly larger than that of the threaded tube 40 and the center of the threaded tube is made in hexagonal to permit use of a hexagonal wrench to fix the tube. The threaded tube 40 after penetrating through the bore of the connector 30 is screwed to a locking sleeve 21 fixed at the rear in a spout assembly 20 by holding against the outer circumference of the spout assembly 20 in relation to the faucet 10. The sleeve 21 related to a recessed hollow cylinder has its outer circumference fixed to the bore of the spout assembly 20, and female threads are provided in the bore of a hole provided on the outer circumference of the sleeve 21 in the direction toward the spout assembly 20 to be locked into the outer diameter of the threaded tube 40. The larger bore in the rear of the hole provides a mobile travel for the insertion of the outer circumference of the connector 30. Spot welding or ultra-sonic welding is used to fix the connector to the locking sleeve and the spout assembly to the faucet.

When assembled, continuous spot welding of mechanical process is used to respectively fix the connector 30 and the locking sleeve 21 to the faucet 10 and the spout assembly 20 before forthwith entering into the next plating process. Then the threaded tube 40 is used as a packing to secure either manually or mechanically both of the connector 30 and the locking sleeve 21 for the faucet 10 to enter into next assembly process.

The present invention is characterized by that:

1. Whereas the connector and the locking sleeve can be processed and produced by automation machine, and both are respectively fixed to the faucet and the spout by spot welding before entering the plating process. Furthermore, as both of the connector and the locking sleeve are welded at where not visible from the appearance, the plating process can be done faster and the plating quality will not be affected by the welded joint.
2. Since no soldering job is required between the and the faucet, the finishing process is skipped to prevent any defects to the plated finish, meaning a significant saving for purchasing expensive finishing tools otherwise required in the conventional process.

I claim:

1. An improved structure of a spout assembly is essentially comprised of a faucet and a spout; wherein, a temperature control valve in shape comprising a bore inside the faucet being fixed in approximately at the middle section of the bore; a water outlet connected through the interior of the temperature control valve being provided at the outer circumference of the faucet in front of the temperature control valve; a cartridge stem extending upward from the upper end of the temperature control valve to control the mixing ratio of hot water and cold water inside the temperature control valve; multiple water inlets being provided at the lower end of the temperature control valve to introduce hot water and cold water into the temperature control valve for mixing at a controlled temperature; a water outlet being provided on the outer circumference at the front of the temperature control valve to deliver the mixed hot and cold water through the water outlet; an inwardly recessed cover in the same outer diameter as that of the faucet being fixed to the upper part of the cartridge stem to cover up the top of the faucet; a chamber being provided inside the cover; a screw being used to externally secure the cover and the cartridge stem: a threaded handle being externally screwed into the front of the cover; those water inlets being connected to multiple water pipes to introduce both hot water and cold water; a cartridge being screwed to the lower part of the faucet; and a packing being provided at where below the cartridge to support the faucet on a sink; a hollow, cylindrical connector being fixed on the inner circumference of the water outlet in the faucet female threads being provided on the inner circumference of the connector to engage a threaded tube and protruding forward with its outer circumference fixed at its rear to the water outlet; a groove being provided on its front circumference to receiver insertion of a O-ring; the tube related to a threaded tube provided with male threads on its outer circumference to be inserted through the connector; the rear end of the threaded tube being formed with a nut in diameter slightly larger than that of the threaded tube; the center of the threaded tube being made in hexagonal to permit use of a hexagonal wrench to fix the tube; the threaded tube after penetrating through the bore of the connector being screwed to a locking sleeve fixed at the rear in a spout holding against the outer circumference of the spout in relation to the faucet the sleeve related to a recessed hollow cylinder having its outer circumference fixed to the bore of the spout; female threads being provided in the bore of a hole on the outer circumference of the sleeve in the direction toward the spout to be locked into the outer diameter of the threaded tube; and the larger bore in the rear of the hole providing a mobile travel for the insertion of the outer circumference of the connector, characterized by that: when assembled, continuous spot welding of mechanical process being used to respectively fix the connector and the locking sleeve to the faucet and the spout before forthwith entering into the next plating process; and the threaded tube securing either manually or mechanically both of the connector and the locking sleeve; the connector and the locking sleeve being respectively fixed to the faucet and the spout by continuous spot welding before entering the plating process.

2. An improved structure of a spout assembly as claimed in claim 1, wherein, spot welding or ultra-sonic welding is used to fix the connector to the locking sleeve and the spout assembly to the faucet.

* * * * *